US008984785B2

(12) United States Patent
Kang

(10) Patent No.: US 8,984,785 B2
(45) Date of Patent: Mar. 24, 2015

(54) DISPLAY DEVICE WITH DECORATIVE FILLED GROOVE

(75) Inventor: Sung Ku Kang, Geumjeong-gu (KR)

(73) Assignee: Samsung Display Co., Ltd., Yongin-si (KR)

( * ) Notice: Subject to any disclaimer, the term of this patent is extended or adjusted under 35 U.S.C. 154(b) by 195 days.

(21) Appl. No.: 13/222,949

(22) Filed: Aug. 31, 2011

(65) Prior Publication Data

US 2012/0110881 A1 May 10, 2012

(30) Foreign Application Priority Data

Nov. 5, 2010 (KR) ..... 10-2010-0110035

(51) Int. Cl.

| | |
|---|---|
| ***F21V 5/00*** | (2006.01) |
| ***G09F 19/12*** | (2006.01) |
| ***G09F 23/00*** | (2006.01) |
| *G09F 13/18* | (2006.01) |

(52) U.S. Cl.

CPC ..... *G09F 19/12* (2013.01); *G09F 23/00* (2013.01); *G09F 2013/189* (2013.01)

USPC ..... 40/737; 362/311.13

(58) Field of Classification Search

USPC ..... 40/204, 205, 714, 716, 737, 798, 799; 362/311.13, 307, 301, 605

See application file for complete search history.

(56) References Cited

U.S. PATENT DOCUMENTS

| | | | | |
|---|---|---|---|---|
| 4,317,303 | A * | 3/1982 | Sernovitz | 40/564 |
| 5,641,221 | A * | 6/1997 | Schindele et al. | 362/501 |
| 6,030,088 | A * | 2/2000 | Scheinberg | 362/85 |
| 6,892,485 | B2 * | 5/2005 | Geyer | 40/541 |
| 6,954,031 | B2 | 10/2005 | Hashimoto et al. | |
| 7,108,414 | B2 * | 9/2006 | McCollum et al. | 362/604 |
| 7,192,334 | B2 | 3/2007 | Hashimoto et al. | |
| 2002/0093608 | A1 * | 7/2002 | Cole et al. | 349/113 |
| 2004/0128882 | A1 * | 7/2004 | Glass | 40/544 |
| 2009/0129049 | A1 * | 5/2009 | Lee et al. | 362/24 |
| 2010/0039826 | A1 * | 2/2010 | Su et al. | 362/311.13 |
| 2010/0320882 | A1 * | 12/2010 | Zhang | 312/204 |
| 2011/0048754 | A1 * | 3/2011 | Xiong et al. | 174/50 |
| 2011/0104435 | A1 * | 5/2011 | Wang | 428/138 |
| 2011/0176325 | A1 * | 7/2011 | Sherman et al. | 362/551 |

FOREIGN PATENT DOCUMENTS

| | | | |
|---|---|---|---|
| CN | 1479560 | A | 3/2004 |
| EP | 1 387 406 | A2 | 2/2004 |
| JP | 2001-166286 | A | 6/2001 |
| JP | 4136799 | B2 | 8/2008 |
| KR | 10-2004-0010342 | A | 1/2004 |
| KR | 10-2007-0070705 | A | 7/2007 |
| TW | 222335 | B | 10/2004 |

* cited by examiner

*Primary Examiner* — Kristina Junge

(74) *Attorney, Agent, or Firm* — Christie, Parker & Hale, LLP

(57) ABSTRACT

A display device includes a display panel for irradiating light, a transparent substrate comprising an active portion for passing through the image light and a decoration portion surrounding the active portion, and a decoration layer filling a groove at the decoration portion.

11 Claims, 5 Drawing Sheets

DISPLAY DEVICE WITH DECORATIVE FILLED GROOVE

CROSS-REFERENCE TO RELATED APPLICATION

This application claims priority to and the benefit of Korean Patent Application No. 10-2010-0110035, filed on Nov. 5, 2010, the entire content of which is hereby incorporated by reference.

BACKGROUND

1. Field

The present disclosure herein relates to a display device.

2. Description of Related Art

Due to reductions in weight, thickness and power consumption, display devices are widely used in televisions, computers and small electronic devices such as portable phones and Personal Digital Assistants (PDAs). As display devices are used in various electronic devices and industries, demands on the aesthetics and performance of display devices are increasing.

SUMMARY

Embodiments of the present invention provide a display device including: a display panel for irradiating image light; a transparent substrate comprising an active portion for transmitting the image light and a decoration portion surrounding the active portion; and a decoration layer filling a groove at the decoration portion.

The transparent substrate may include a first surface adjacent to the display panel, and a second surface opposite the first surface, the groove may be at a first surface of the decoration portion, and the decoration layer may be on the first surface of the decoration portion.

The decoration layer may include a plurality of segments which are located at edge portions adjacent to respective sides of the transparent substrate and extended along the respective sides.

The groove may include a plurality of grooves, and one segment of the plurality of segments fills the plurality of grooves.

The width of the one segment of the plurality of segments may be greater than widths of another of the plurality of segments.

The decoration layer may include a convex portion filling the groove, and a flat portion.

The convex portion may form a sign.

An exterior surface of the convex portion may be a curved surface.

Light received from outside to the decoration layer may be diffuse reflected light.

The display device may further include first and second sensing lines arranged on the transparent substrate, and respectively extended in a first direction and a second direction intersecting the first direction.

According to an embodiment of the present invention a method of manufacturing a display device includes: preparing a transparent substrate which comprises an active portion and a decoration portion surrounding the active portion; forming a mask pattern which exposes a portion of the decoration portion, on the transparent substrate; etching the exposed portion of the decoration portion to form a groove by using the mask pattern as a mask; and placing the transparent substrate on a display panel, wherein the active portion is configured to transmit image light irradiated from the display panel.

The method may further include forming a decoration layer which fills the groove.

The method may further include removing the mask pattern before forming the decoration layer.

The etching the exposed portion of the decoration portion may include wet etching.

The etching the exposed portion of the decoration portion may form a sign.

BRIEF DESCRIPTION OF THE DRAWINGS

The accompanying drawings are included to provide a further understanding of the embodiments of the present invention, and are incorporated in and constitute a part of this specification. The drawings illustrate exemplary embodiments of the present invention and, together with the description, serve to explain principles of the embodiments of the present invention. In the drawings.

DETAILED DESCRIPTION

Figure 1:
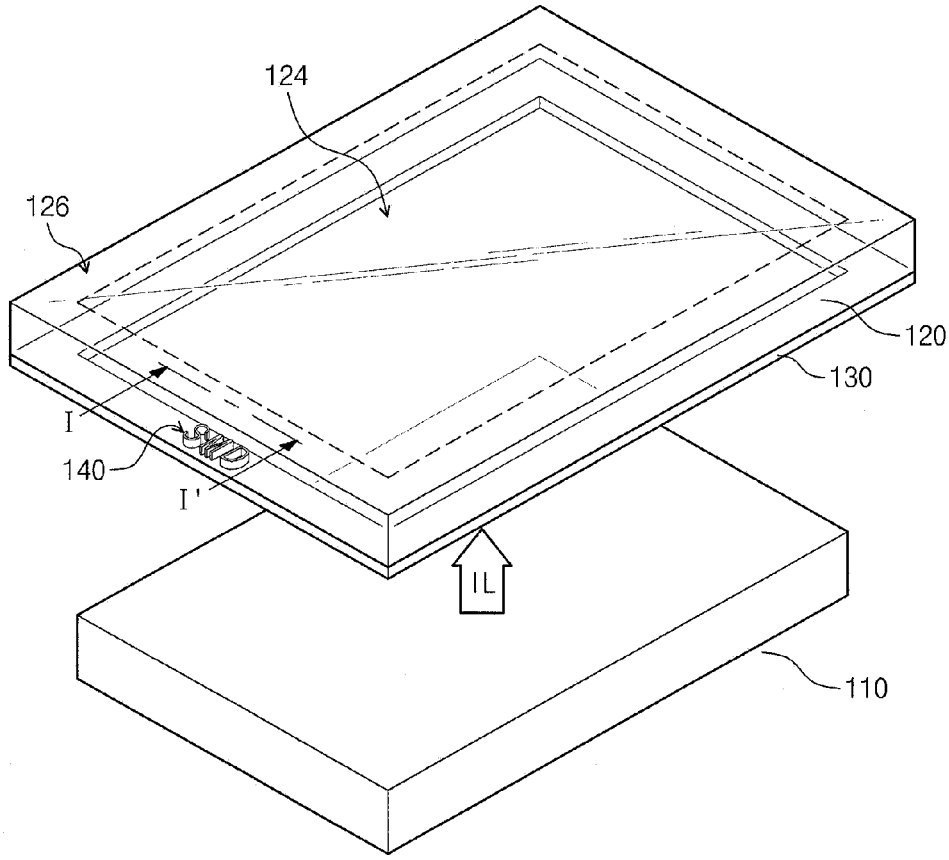
FIG. 1 is a schematic view illustrating a display device according to an embodiment of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

It is also to be understood that when a layer (or film) is referred to as being 'on' another layer (or film) or substrate, it may be directly on the other layer or substrate, or intervening layers may also be present between the layer (or film) and the other layer (or film) or substrate. In the figures, the dimensions of layers and regions are exaggerated for clarity of illustration. Also, though terms like a first, a second, and a third are used to describe various regions and layers in various embodiments of the present invention, the regions and the layers are not limited to these terms. These terms are used only to discriminate one region or layer from another region or layer.

Embodiments described herein include complementary embodiments thereof. In the specification, the term 'and/or' is used as meaning in which the term includes at least one of preceding and succeeding elements. Like reference numerals refer to like elements throughout.

A display device according to embodiments of the present invention will be described below. FIG. 1 is a schematic view illustrating a display device according to an embodiment of the present invention. For convenience, the design of a decoration layer to be described below will be omitted.

Referring to FIG. 1, a display device according to an embodiment of the present invention includes a display panel 110, a transparent substrate 120, and a decoration layer 130.

The display panel 110 may irradiate image light IL. The display panel 110 may be, but is not limited to, a liquid crystal display panel, an organic light emitting display panel, or a plasma display panel. In addition, the display panel 110 may be another kind of display panel.

The transparent substrate 120 may be located at the display panel 110. The transparent substrate 120 may include an active portion 124, and a decoration portion 126 surrounding the active portion 124. The active portion 124 may be the center portion of the transparent substrate 120 through which the image light IL, irradiated from the display panel 110, passes (or is transmitted).

The decoration portion 126 may be a portion of the transparent substrate 120 that overlaps with the decoration layer 130. When the decoration layer 130 is located at the edge portion of the transparent substrate 120, the decoration portion 126 may be the edge portion of the transparent substrate 120. For example, in a plan view, when the transparent substrate 120 has a quadrangular shape, the decoration portion 126 may include the respective sides of the transparent substrate 120, and include four edge portions that are extended along the respective sides. The width of one edge portion of the decoration portion 126 including one side of the transparent substrate 120 may be greater than the widths of other edge portions of the decoration portion 126 respectively including the other sides of the transparent substrate 120. In other embodiments, the edge portions of the decoration portion 126 may all have the same width.

The transparent substrate 120 may be formed of a transparent material. For example, the transparent substrate 120 may be a glass substrate. Alternatively, the transparent substrate 120 may be a transparent plastic substrate.

One surface of the transparent substrate 120 adjacent to the display panel 110 may include a plurality of grooves, which may be filled by the decoration layer 130. This will be further described below with reference to FIGS. 2A and 2B.

Figure 2A:
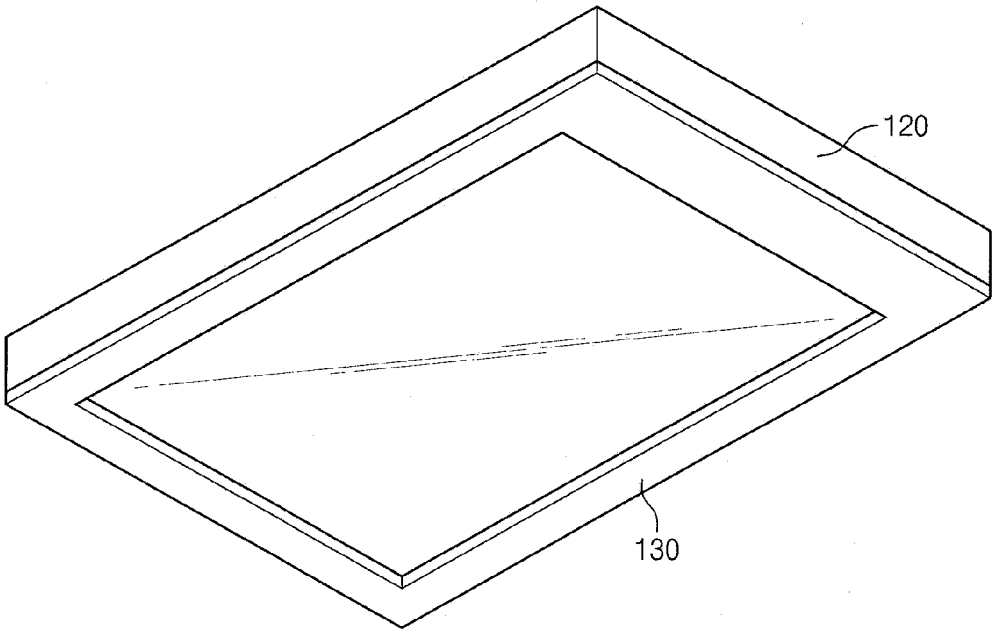
FIG. 2A is a perspective view illustrating a transparent substrate and a decoration layer which are included in a display device according to an embodiment of the present invention.
Figure 2B:
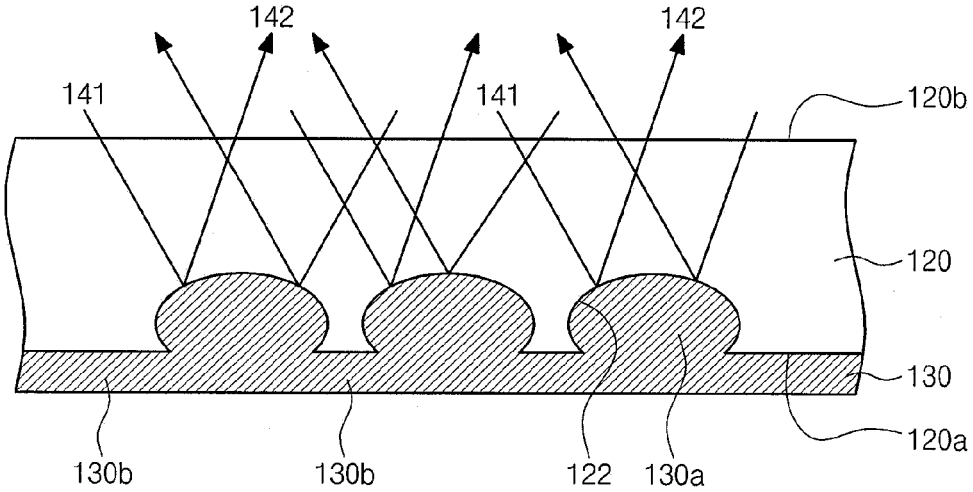
FIG. 2B is a cross-sectional view taken along the line I-I' of FIG. 1.

FIGS. 2A and 2B are views for describing a transparent substrate and a decoration layer which are included in a display device according to an embodiment of the present invention. FIG. 2A is a perspective view illustrating a transparent substrate and a decoration layer which are included in a display device according to an embodiment of the present invention. FIG. 2B is a cross-sectional view taken along the line I-I' of FIG. 1. For convenience, the design of the decoration layer will be omitted in FIG. 2A.

Referring to FIGS. 1, 2A, and 2B, the transparent substrate 120 may include a first surface 120*a*, and a second surface 120*b* facing the first surface 120*a*. The first surface 120*a* may be adjacent to the display panel 110. Image light IL irradiated from the display panel 110 may be transmitted to the first surface 120*a* of the transparent substrate 120, and then irradiated from the second surface 120*b*.

The first surface 120*a* of the transparent substrate 120 may have a concave-convex structure including a plurality of grooves 122. The grooves 122 may be formed at the first surface 120*a* of the decoration portion 126. The grooves 122 may be formed at the first surface 120*a* of the one edge portion having the width greater than the widths of the other edge portions among the edge portions included in the decoration portion 126. In this case, the first surfaces 120*a* of the other edge portions may be substantially flat. In other embodiments, the grooves 122 may be formed at the first surfaces 120*a* of a two or more the edge portions included in the decoration portion 126.

The thickness of a portion of the transparent substrate 120 including the grooves 122 may be less than (e.g., thinner than) than that of another portion of the transparent substrate 120 having no grooves 122. The depths of each of the grooves 122 may be substantially the same. For example, the depths of the grooves 122 may be about 10 μm to about 50 μm. On the other hand, the depths of the grooves 122 may differ. The interior surfaces of the grooves 122 may be a substantially curved surface. The grooves 122 may be filled by the decoration layer 130.

The decoration layer 130 may be located at the first surface 120*a* of the transparent substrate 120. The decoration layer 130 may cover the first surface 120*a* of the decoration portion 126. The decoration layer 130 may be located at the edge portion of the first surface 120*a*. The decoration layer 130 may be located at edge portions adjacent to the respective sides of the first surface 120*a* of the transparent substrate 120, and include a plurality of segments that are extended along the respective sides. For example, when the transparent substrate 120 has a quadrangular shape, the decoration layer 130 may include four segments that are extended along the respective sides of the transparent substrate 120.

The segments of the decoration layer 130 may cover the first surfaces 120*a* of the edge portions of the decoration portion 126, respectively. Among the segments, one segment may have a width that is greater than the widths of the other segments. In this case, a portion of the transparent substrate 120 overlapping with the one segment of the decoration layer 130 may be the one edge portion of the decoration portion 126. When the grooves 122 are formed at the first surface 120*a* of the one edge portion of the decoration portion 126, they may be filled by the one segment. In other embodiments, when grooves are respectively formed at the first surfaces 120*a* of the edge portions of the decoration portion 126, the segments of the decoration layer 130 may fill the grooves that are formed at the first surfaces 120*a* of the edge portions of the decoration portion 126, respectively.

The decoration layer 130 may include a plurality of convex portions 130*a* filling the grooves 122, and a flat portion 130*b* formed on the transparent substrate 120 having no grooves 122. The decoration layer 130 may have a concave-convex structure which includes the convex portions 130*a* and the flat portion 130*b*. When each of the interior surfaces of the grooves 122 is a curved surface, each of the exterior surfaces of the convex portions 130*a* contacting the interior surfaces of the grooves 122 may be a curved surface.

The convex portions 130*a* may configure (e.g., represent or form) a sign 140. The sign 140 may be recognizable by a person, a machine, and/or an electronic device. The sign 140 may include a symbol, a character, or a mark, that is used for conveying a meaning or a signal to a person, a machine, and/or an electronic device. For example, the grooves 122 may configure a trademark indicating the source of the display device according to an embodiment of the present invention. On the other hand, the convex portions 130*a* may configure a design. The design may be a graphic for decorating the display device according to an embodiment of the present invention. The convex portions 130*a* may also concurrently (e.g., simultaneously) configure (e.g., form) both the sign 140 and the design.

External light 141 may pass through the second surface 120*b* of the transparent substrate 120 and be transmitted to the decoration layer 130. As described above, the decoration layer 130 has a concave-convex structure, and light transmitted to the decoration layer 130 may be diffuse reflected. Light 142 reflected by the convex portions 130*a* and the flat portion 130*b* may pass through the second surface 120*b* of the transparent substrate 120 and be transmitted to the outside.

Due to diffuse reflection, the reflected light 142, reflected from the convex portions 130*a*, may appear to a user's eyes as having a sense of volume. Therefore, it can be seen by a user's eyes that the sign 140, configured with the convex portions 130*a*, has a sense of volume (e.g., depth).

Figure 3A:
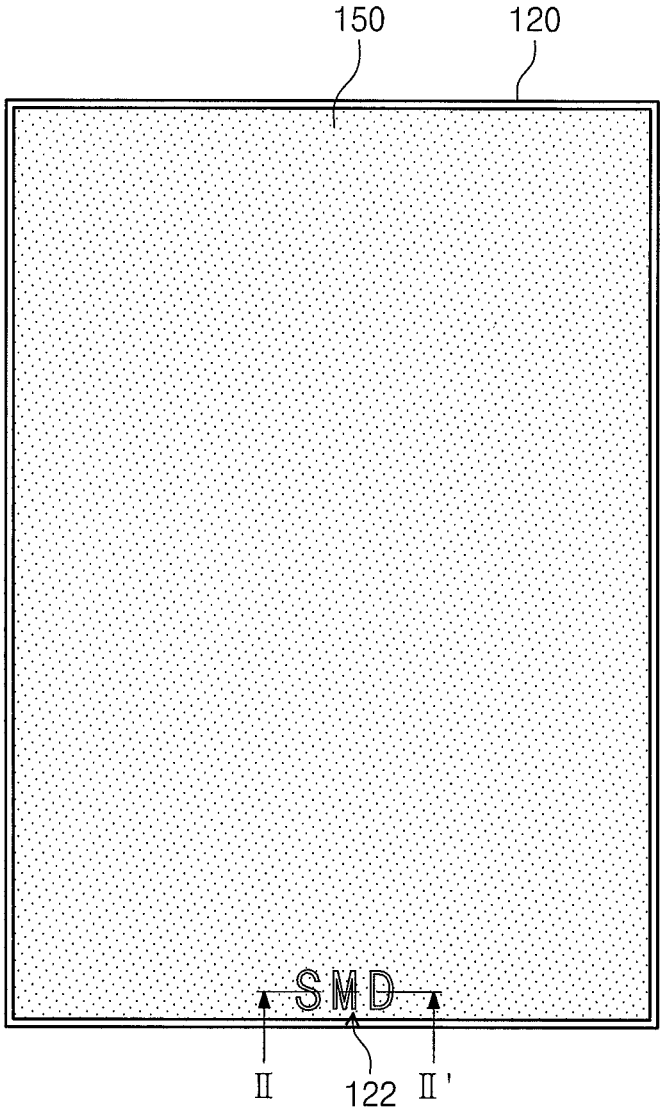
FIG. 3A is a plan view illustrating a method of manufacturing a display device according to an embodiment of the present invention.
Figure 3B:
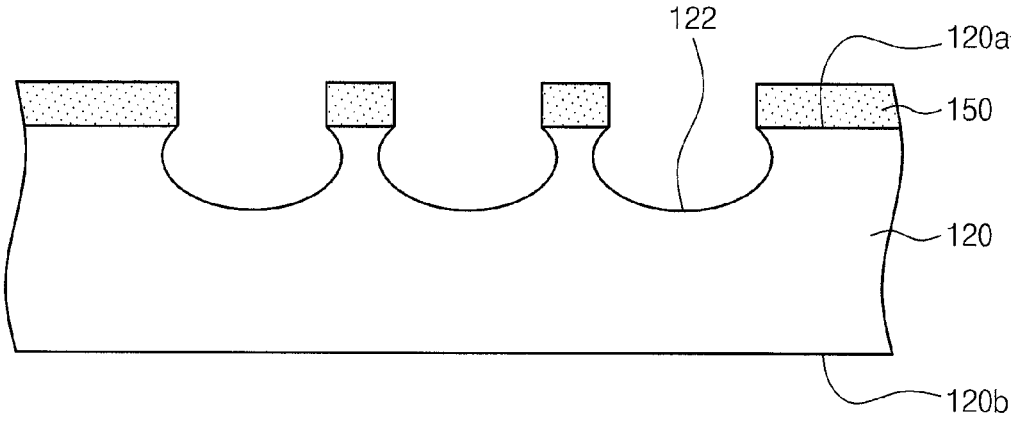
FIG. 3B is a cross-sectional view taken along the line II-II' of FIG. 3A.

A method of manufacturing a display device according to an embodiment of the present invention will be described below. FIG. 3A is a plan view illustrating a method of manufacturing a display device according to an embodiment of the present invention. FIG. 3B is a cross-sectional view taken along the line II-II' of FIG. 3A.

Referring to FIGS. 3A and 3B, a transparent substrate 120 may be prepared. The transparent substrate 120 may include an active portion, and a decoration portion surrounding the active portion. The active portion may be the center portion of the transparent substrate 120, and the decoration portion may be the edge portion of the transparent substrate 120. The transparent substrate 120 may include a first surface 120*a*, and a second surface 120*b* opposite the first surface 120*a*. The transparent substrate 120 may be formed of a transparent material.

A mask pattern 150 may be formed on the first surface 120*a* of the transparent substrate 120. The mask pattern 150 may be formed of a material having an etch selectivity with respect to the transparent substrate 120. For example, the mask pattern 150 may be formed using a screen printing process. In other embodiments, the mask pattern 150 may be a photoresist pattern that is formed by e.g., a photolithography process. The mask pattern 150 may expose a portion of the decoration portion of the transparent substrate 120.

A portion of the decoration portion exposed by the mask pattern 150 may form a sign. The sign may be the same as the sign 140 that has been described above with reference to FIG. 1. On the contrary, the exposed portion of the decoration portion may form the design that has been described above with reference to FIG. 1, or may concurrently (e.g., simultaneously) form both a sign and a design.

The exposed portion of the decoration portion may be etched using the mask pattern 150 as a mask. The exposed portion of the decoration portion may be etched, and thus a plurality of grooves 122 may be formed on the first surface 120*a* of the transparent substrate 120. The grooves 122 may form the sign 140 that has been described above with reference to FIG. 1. On the contrary, the grooves 122 may form the design that has been described above with reference to FIG. 1, or may concurrently (e.g., simultaneously) form both a sign and a design.

The exposed portion of the decoration portion may be isotropically etched. For example, the exposed portion of the decoration portion may be wet etched. In this case, the exposed portion of the decoration portion may be etched using HF or $NH_4F$, or by using a combination of HF and $NH_4F$. When the exposed portion of the decoration portion is wet etched, each of the interior surfaces of the grooves 122 may be a substantially curved surface. On the other hand, the exposed portion of the decoration portion may be anisotropically etched. In this case, a dry etching process and/or a wet etching process may be used.

The transparent substrate 120 may be etched using the mask pattern 150 as a mask, and thereafter the mask pattern 150 may be removed.

Referring again to FIGS. 2A and 2B, the mask pattern 150 may be removed, and thereafter the decoration layer 130 may be formed at the first surface 120*a* of the transparent substrate 120. The decoration layer 130 may be formed to fill the grooves 122 that are formed at the first surface 120*a* of the transparent substrate 120. The decoration layer 130 may be formed at the edge portion of the first surface 120*a* of the transparent substrate 120.

The decoration layer 130 may be formed using a printing process or a deposition process. The decoration layer 130 may be formed of a material having color. For example, the decoration layer 130 may include an epoxy-based material, an acrylic-based material or a dye. For example, the decoration layer 130 may be black. On the other hand, the decoration layer 130 may be formed of a material having various colors.

The decoration layer 130 may be formed, and thereafter the transparent substrate 120 may be positioned on the display panel 110. In order for the first surface 120*a* of the transparent substrate 120 to be adjacent to the display panel 110, the transparent substrate 120 may be positioned on the display panel 110.

According to another embodiment, the transparent substrate 120 may be included in a touch screen panel. In this case, the touch screen panel may be positioned on the transparent substrate 120 and include a plurality of sensing lines that cross each other. This will be described below in detail with reference to FIG. 4.

Figure 4:
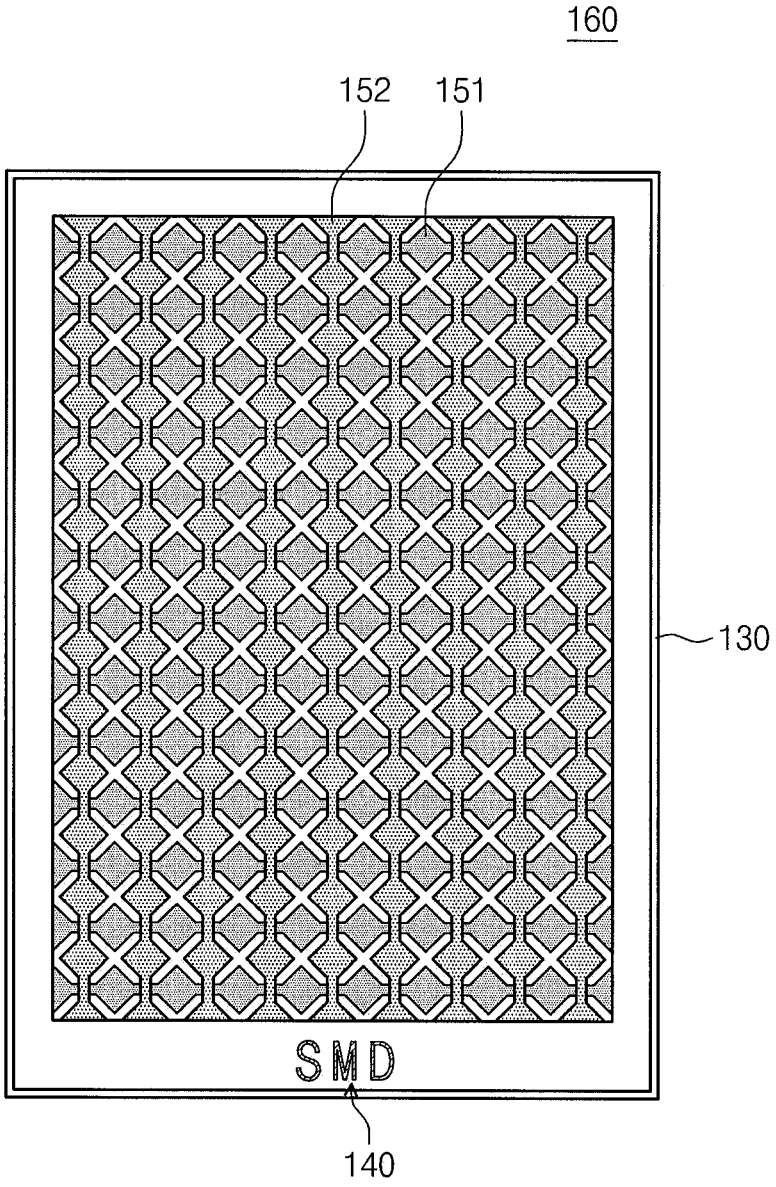
FIG. 4 is a plan view illustrating a display device according to another embodiment of the present invention.

FIG. 4 is a plan view illustrating a display device according to another embodiment of the present invention.

Referring to FIG. 4, a display device according to another embodiment of the present invention may include a touch screen panel 160. The touch screen panel 160 may include a transparent substrate 120 and a decoration layer 130 as described above with reference to FIGS. 1, 2A, and 2B. First and second sensing lines 151 and 152 may be formed on the transparent substrate 120. The first and second sensing lines 151 and 152 may be formed on a first surface of the transparent substrate 120 at which the decoration layer 130 is formed. A portion of the first and second sensing lines 151 and 152 may overlap with the decoration layer 130.

The first sensing lines 151 may be extended parallel in a first direction, and the second sensing lines 152 may be extended parallel in a second direction. The second direction may be perpendicular to the first direction. The first and second sensing lines 151 and 152 may be insulated from each other. An inorganic insulation layer or an organic insulation layer covering the first and second sensing lines 151 and 152 may be further arranged.

Each of the first sensing lines 151 may include a plurality of first sensing patterns that are arranged in the first and second directions. The first sensing patterns arranged in the first direction may configure a row, and the first sensing patterns arranged in the second direction may configure a column. The first sensing patterns in the same row may be connected, and thereby configure the first sensing lines 151.

Each of the second sensing lines 152 may include a plurality of second sensing patterns that are arranged in the first and second directions. The second sensing patterns may be insulated from the first sensing patterns. The second sensing patterns arranged in the first direction may configure a row, and the second sensing patterns arranged in the second direction may configure a column. The second sensing patterns in the same column may be connected, and thereby configure the second sensing lines 152.

According to embodiments of the present invention, the transparent substrate includes the active portion through which image light irradiated from the display panel passes, and the decoration portion surrounding the active portion. The decoration layer filling the groove that is formed in the decoration portion is located on the transparent substrate. The use of a transparent substrate including an active portion and a decoration portion may also result in an aesthetically pleasing display device. Further the use of grooves to diffuse reflect light may give a sense of volume to a user.

The above-disclosed subject matter is to be considered illustrative and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A display device comprising:

a display panel for irradiating image light;

a transparent substrate comprising an active portion which transmits the image light and a decoration portion surrounding the active portion; and a decoration layer contacting the transparent substrate and comprising a convex portion and a flat portion, the convex portion extending into and filling a groove at the decoration portion, and the flat portion connected with the convex portion and located on the decoration portion having no grooves, wherein the transparent substrate has a first surface adjacent to the display panel and a second surface opposite the first surface, and the groove is at the first surface of the transparent substrate.

2. The display device of claim 1, wherein the decoration layer comprises a plurality of segments which are located at edge portions adjacent to respective sides of the transparent substrate and extended along the respective sides.

3. The display device of claim 2, wherein:

the groove comprises a plurality of grooves, and one segment of the plurality of segments fills the plurality of grooves.

4. The display device of claim 3, wherein the width of the one segment of the plurality of segments is greater than widths of another of the plurality of segments.

5. The display device of claim 1, wherein the convex portion forms a sign.

6. The display device of claim 1, wherein an exterior surface of the convex portion is a curved surface.

7. The display device of claim 1, wherein the decoration layer diffuses light entering from outside of the display device.

8. The display device of claim 1, further comprising: first and second sensing lines arranged on the transparent substrate, and respectively extended in a first direction and a second direction intersecting the first direction.

9. The display device of claim 1, wherein the decoration layer completely fills the groove at the decoration portion.

10. The display device of claim 1, wherein the decoration layer comprises multiple convex portions and the flat portion connects the multiple convex portions.

11. A display device comprising:

a display panel for irradiating image light;

a transparent substrate comprising an active portion which transmits the image light and a decoration portion surrounding the active portion;

a decoration layer contacting the transparent substrate and comprising a convex portion and a flat portion, the convex portion extending into and filling a groove at the decoration portion, and the flat portion connected with the convex portion and located on the decoration portion having no grooves, wherein the transparent substrate has a first surface adjacent to the display panel and a second surface opposite the first surface, and the groove is at the first surface of the transparent substrate, wherein the display panel is a liquid crystal display panel, an organic light emitting display panel, or a plasma display panel.

* * * * *